US012220076B1

(12) United States Patent
Truttmann

(10) Patent No.: US 12,220,076 B1
(45) Date of Patent: Feb. 11, 2025

(54) COMFORT SYSTEM FOR USE WITH A MATTRESS

(71) Applicant: Wicked Sheets, LLC, Louisville, KY (US)

(72) Inventor: Allison M. Truttmann, Louisville, KY (US)

(73) Assignee: Wicked Sheets, LLC, Louisville, KY (US)

( * ) Notice: Subject to any disclaimer, the term of this patent is extended or adjusted under 35 U.S.C. 154(b) by 364 days.

(21) Appl. No.: 17/571,012

(22) Filed: Jan. 7, 2022

Related U.S. Application Data

(60) Provisional application No. 63/135,832, filed on Jan. 11, 2021.

(51) Int. Cl.
*A47G 9/02* (2006.01)

(52) U.S. Cl.
CPC ..... *A47G 9/0238* (2013.01)

(58) Field of Classification Search
CPC ..... A47C 21/02; A47C 21/022; A47C 21/028; A47C 27/005; A47G 9/0238; A47G 9/0246; A47G 9/04
See application file for complete search history.

(56) References Cited

U.S. PATENT DOCUMENTS 116,013 A * 6/1871 Birkenhead ..... A47C 21/022 24/72.5
438,639 A * 10/1890 Rapelye ..... A47C 21/022 24/72.5
827,260 A * 7/1906 Name not available ..... A47C 21/022 24/72.5
828,800 A * 8/1906 Name not available ..... A47C 21/022 24/72.5
921,439 A * 5/1909 Name not available ..... A47G 9/04 2/114
1,283,184 A * 10/1918 Name not available ..... A47C 21/022 24/72.5
1,491,160 A * 4/1924 Meunier ..... A47C 21/022 24/72.5
1,562,809 A * 11/1925 Thompson ..... A61G 7/065 5/499
1,742,064 A * 12/1929 Dinstuhl ..... A47G 9/0238 5/498
1,892,841 A * 1/1933 Kaufmann ..... A47C 21/022 24/301

(Continued)

*Primary Examiner* — Eric J Kurilla
(74) *Attorney, Agent, or Firm* — Stites & Harbison, PLLC; David W. Nagle, Jr.; Gary N. Stewart

(57) ABSTRACT

A comfort system for use with a mattress comprises: a base layer configured for placement below the mattress, including a central portion that is configured to extend from a first side of the mattress to a second side, with one or more appendages extending from the central portion; and a top layer configured for placement over an upper surface of the mattress, including a central portion that is configured to extend from the first side of the mattress to the second side, with one or more appendages extending from the central portion. Each of the appendages of the top layer includes a closure means that is adapted to engage a corresponding closure means on one of the appendages of the base layer. The comfort system can be moved along the length of the mattress, and the material of the top layer can be selected for a particular malady or use.

10 Claims, 3 Drawing Sheets

(56) References Cited

U.S. PATENT DOCUMENTS 1,897,521 A * 2/1933 Lagarde ..... A47C 31/105 5/499
2,024,050 A * 12/1935 May ..... A47C 21/022 24/72.5
2,155,690 A * 4/1939 Simpson ..... A47C 21/022 5/498
2,188,576 A * 1/1940 Mulloy ..... A47C 21/022 24/72.5
2,321,394 A * 6/1943 King ..... A47C 21/022 24/72.5
2,450,923 A * 10/1948 Spiro, Jr. ..... A47G 9/04 5/499
2,507,091 A * 5/1950 Carlson ..... A47C 21/022 24/72.5
2,537,652 A * 1/1951 Churchill ..... A47C 27/005 5/499
2,729,831 A * 1/1956 Fuld ..... A47G 9/04 5/494
2,883,683 A * 4/1959 Burk ..... A47C 27/001 5/722
2,103,244 A * 4/1960 Briscoe ..... A47C 21/022 24/72.5
2,931,084 A * 4/1960 De Witt ..... A47C 31/105 24/72.5
3,011,182 A * 12/1961 Burks ..... A47C 31/105 5/484
3,066,321 A * 12/1962 Kintner ..... A47C 31/105 297/DIG. 6
3,286,284 A * 11/1966 Klogether ..... A47C 27/005 5/500
3,394,416 A * 7/1968 Hale ..... A47C 27/005 5/486
3,436,771 A * 4/1969 Fisher ..... A47G 9/0246 5/499
4,045,831 A * 9/1977 Clark ..... A47G 9/0238 5/497
4,627,122 A * 12/1986 Hopp ..... A61F 5/485 5/487
4,662,016 A * 5/1987 Seeman ..... A47C 21/022 24/72.5
4,712,261 A * 12/1987 Castro ..... A47C 21/022 24/72.5
5,153,957 A * 10/1992 Price, Sr. ..... A47G 9/02 5/500
5,221,273 A * 6/1993 Graham ..... A47C 27/005 5/500
5,946,751 A * 9/1999 DeMay ..... A47G 9/0292 24/72.5
6,014,782 A * 1/2000 Stevenson ..... A47G 9/0238 5/907
6,216,292 B1 * 4/2001 Oakhill ..... A47C 31/123 5/907
6,233,762 B1 * 5/2001 Bradley ..... A47C 21/022 5/500
6,233,764 B1 * 5/2001 Orr ..... A47G 9/0246 5/692
6,286,163 B1 * 9/2001 Trimble ..... A47G 9/0246 5/497
6,845,532 B1 * 1/2005 Rosenblum ..... A47C 27/008 5/907
7,849,532 B1 * 12/2010 Servais ..... A47G 9/0246 5/81.1 HS
8,566,983 B2 * 10/2013 Monaco ..... A47C 21/022 5/494
8,635,724 B2 * 1/2014 Moorhouse ..... A47G 9/02 5/482
8,875,324 B2 * 11/2014 Borgione ..... A47G 9/10 5/490
9,232,866 B1 * 1/2016 Hix ..... A47G 9/04
D837,571 S * 1/2019 Keever ..... D6/606
D873,584 S * 1/2020 Monfalcone, III ..... D6/606
11,259,642 B2 * 3/2022 Engemann ..... A47C 21/022
2005/0028278 A1 * 2/2005 Landry ..... A61F 5/3776 5/482
2007/0240262 A1 * 10/2007 Johnson ..... A47G 9/0223 5/498
2008/0086814 A1 * 4/2008 Wootten ..... A47C 27/005 5/497
2010/0269259 A1 * 10/2010 Campbell ..... A47C 21/022 5/498
2015/0374568 A1 * 12/2015 Miralles ..... A61G 7/02 4/452
2017/0208957 A1 * 7/2017 Keever ..... A47C 31/105
2020/0085200 A1 * 3/2020 Engemann ..... A47C 21/022
2022/0110454 A1 * 4/2022 Speters ..... A47C 21/00
2024/0016305 A1 * 1/2024 Bolar ..... A47C 31/105

* cited by examiner

COMFORT SYSTEM FOR USE WITH A MATTRESS

CROSS-REFERENCE TO RELATED APPLICATIONS

The present application claims priority to U.S. Patent Application Ser. No. 63/135,832 filed on Jan. 11, 2021, the entire disclosure of which is incorporated herein by reference.

BACKGROUND OF THE INVENTION

Mattresses have been in use for centuries for supporting an individual in a lying position. In modern times, mattresses are constructed in various manners, but ordinarily are in the form of a rectangular case that contains cushioning and/or shock-absorbing materials, such as cotton, foam rubber, a framework of metal springs, or fluids.

Bedding is commonly placed over and on a mattress for comfort and hygiene. Bedding is commonly in the forms of sheets, blankets, and pillows. With respect to the sheets that are placed over or on a mattress, the sheets are often made from cotton, cotton/polyester blends, and similar fabrics. The selection of fabric for the sheets may depend on the individual using the bedding, taking into account his/her preferences, and, in some cases, taking into account medical conditions.

For example, for an individual prone to bedsores, a layer of wicking material (i.e., a blend of polyester and nylon) combined with a layer of padded material may be preferred. For another example, for an individual prone to night sweats or hot flashes, a wicking material alone may be preferred to draw moisture and heat away from the body. For yet another example, an absorbent material might be needed for an individual with incontinence.

SUMMARY OF THE INVENTION

The present invention is a comfort system for use with a mattress.

A comfort system for use with a mattress comprises: a base layer configured for placement below the mattress, including a central portion that is configured to extend from a first side of the mattress to a second side of the mattress, with one or more appendages that extend from a first edge of the central portion of the base layer, and with one or more appendages that extend from a second edge of the central portion of the base layer; and a top layer configured for placement over an upper surface of the mattress, including a central portion that is configured to extend from the first side of the mattress to the second side of the mattress, with one or more appendages that extend from a first edge of the central portion of the top layer, and with one or more appendages that extend from a second edge of the central portion of the top layer. Each of the appendages of the top layer includes a closure means that is adapted to engage a corresponding closure means on one of the appendages of the base layer.

In use, the base layer of the comfort system is positioned below the mattress. The base layer is solely for positioning for the comfort system, and thus, one preferred material for the base layer is duck cloth, which is a heavy, plain-woven cotton fabric that is strong, durable, and machine-washable. Duck cloth can also be treated with antimicrobial solutions if needed for a particular environment, such as a healthcare setting.

In thus, the top layer is placed over an upper surface of the mattress. The top layer is intended to contact the body of an individual. The material for the top layer will depend on which part of the body it is intended to contact.

The top layer is connected to the base layer via the respective appendages on either side of the mattress and the closure means carried by those appendages. With respect to connecting the base layer to the top layer, snap fasteners are particularly well-suited for the closure means.

Again, the top layer is intended to contact the body of an individual, and the material for the top layer will depend on which part of the body it is intended to contact. In this regard, the mattress can be characterized as having multiple zones. The comfort system can be moved along the length of the mattress to correspond to any of these zones, and the material of the top layer can be selected to correspond with the body part(s) most often in each zone.

The present invention may also be characterized as a kit, with a single base layer and multiple top layers, with each of the top layers being comprised of a different material suitable for a particular malady or use.

DETAILED DESCRIPTION OF THE INVENTION

The present invention is a comfort system for use with a mattress.

Figure 1:
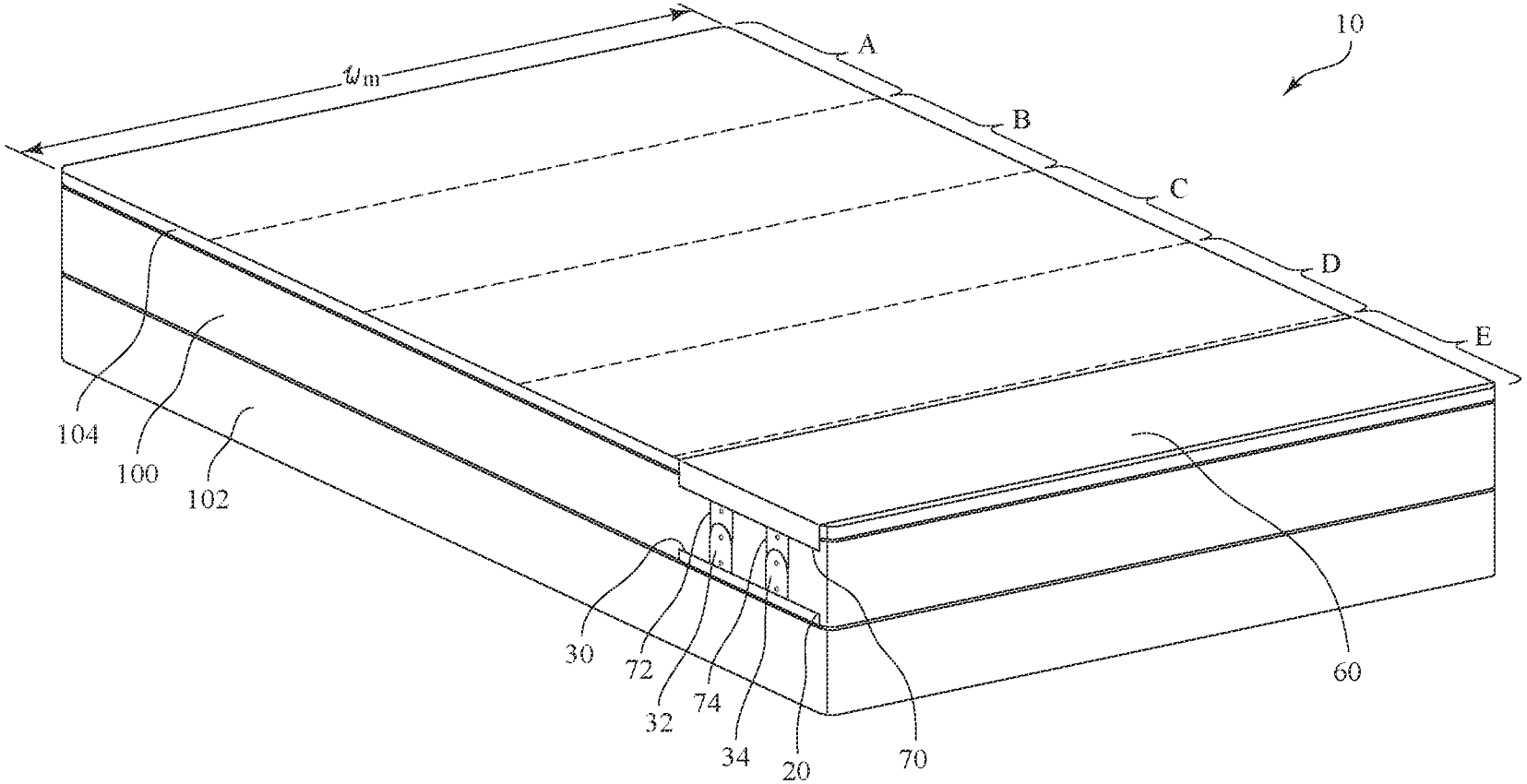
FIG. 1 is a perspective view of an exemplary comfort system made in accordance with the present invention in use with a mattress.
Figure 2:
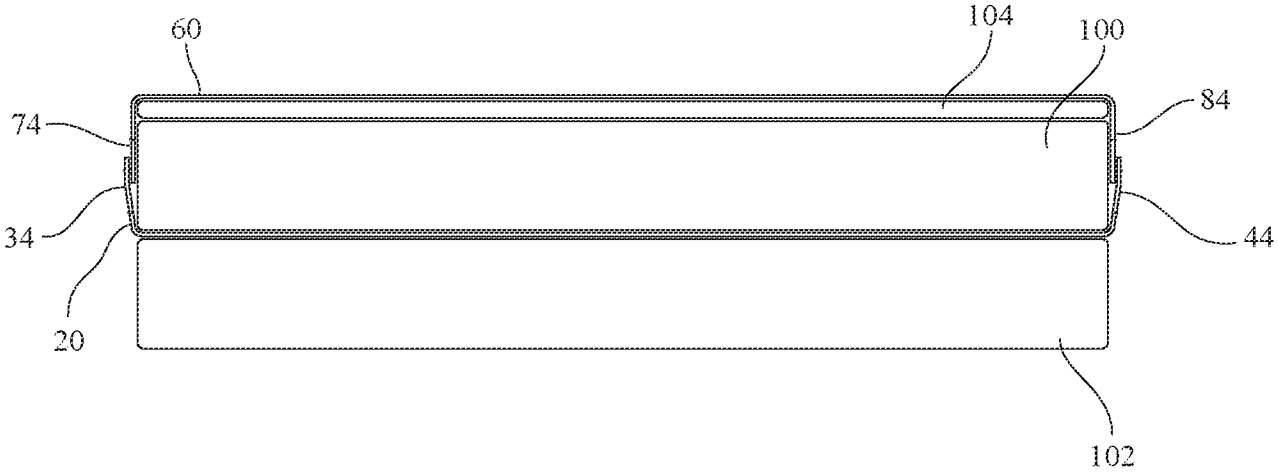
FIG. 2 is an end view of the exemplary comfort system of FIG. 1.

Referring first to FIGS. 1-2, in this example, a mattress 100 is supported by a box springs 102 and covered with a mattress pad 104. A base layer 20 of an exemplary comfort system 10 made in accordance with the present invention is positioned below the mattress 100, in this case, between the mattress 100 and box springs 102.

Figure 3:
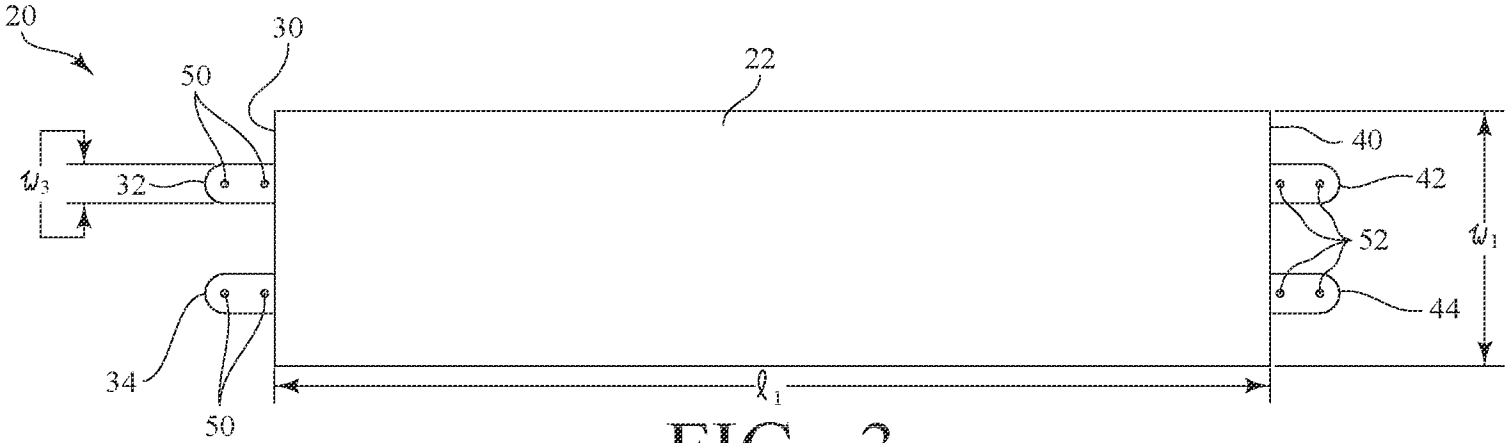
FIG. 3 is a plan view of a base layer of the comfort system of FIG. 1.

Referring now to FIG. 3, in this exemplary embodiment, the base layer 20 includes a central portion 22 that is configured to extend from a first side of the mattress 100 to a second side of the mattress 100. Thus, the base layer 20 preferably has a length, $l_1$, that is substantially equal to or slightly greater than the width, $w_m$, of the mattress 100. The central portion 22 of the base layer 20 includes a first edge 30 and a second edge 40. Two appendages (or straps) 32, 34 extend from the first edge 30 of the central portion 22 of the base layer 20; however, fewer or more appendages could also extend from the first edge 30 of the central portion 22 of the base layer 20 without departing from the spirit and scope of the present invention. Each of the appendages 32, 34 includes a closure means 50, which, in this exemplary embodiment, is in the form of a first (top) portion of a snap fastener. Indeed, in this exemplary embodiment, there are two such closure means 50 on each appendage 32, 34, the importance of which is described below.

Referring still to FIG. 3, two appendages (or straps) 42, 44 also extend from the second edge 40 of the central portion 22 of the base layer 20; however, fewer or more appendages could also extend from the second edge 40 of the central portion 22 of the base layer 20 without departing from the spirit and scope of the present invention. Each of the appendages 42, 44 includes a closure means 52, which, in this exemplary embodiment, is again in the form of a first (top) portion of a snap fastener. Indeed, in this exemplary embodiment, there are two such closure means 52 on each appendage 42, 44, the importance of which is described below.

Referring still to FIG. 3, the appendages 32, 34, 42, 44 may be integral with the central portion 22 of the base layer 20, or the appendages 32, 34, 42, 44 may be separate components sewn or similarly secured to the central portion 22 of the base layer 20. In this exemplary embodiment, the appendages 32, 34, 42, 44 are separate components and constructed of an elastic material. The appendages 32, 34, 42, 44 are sewn to the respective first and second edges 30, 40 of the central portion 22 of the base layer 20.

Referring again to FIGS. 1-2, a top layer 60 is placed over an upper surface of the mattress 100 (and, in this case, on top of the mattress pad 104 and any fitted sheets secured to the mattress 100 and/or mattress pad 104).

Figure 4:
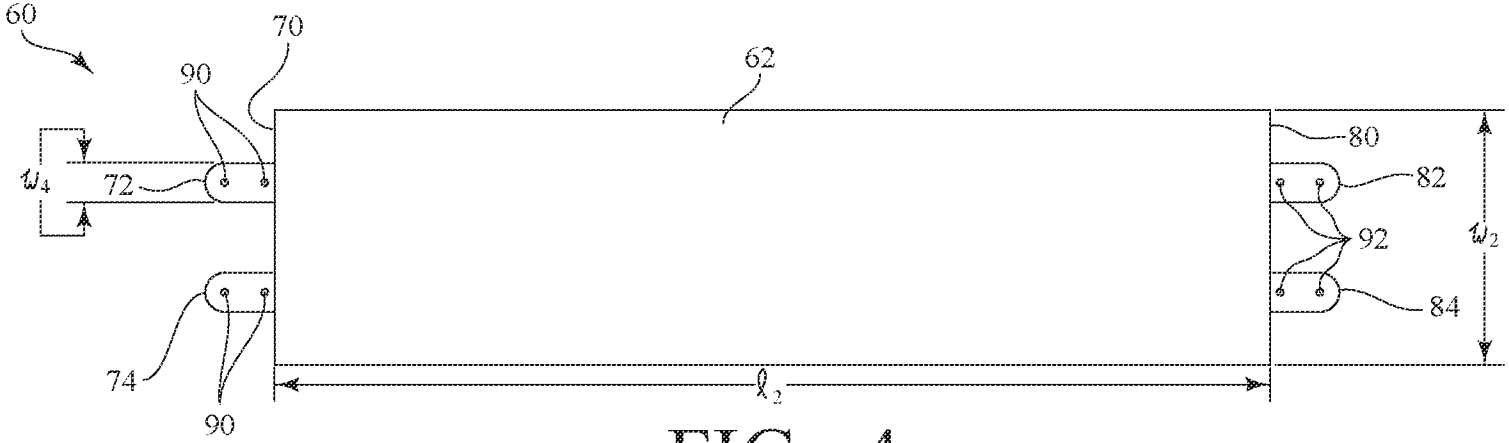
FIG. 4 is a plan view of a top layer of the comfort system of FIG. 1.

Referring now to FIG. 4, the top layer 60 includes a central portion 62 that is configured to extend from the first side of the mattress 100 to the second side of the mattress 100. Thus, the top layer 20 also preferably has a length, $l_2$, that is substantially equal to or slightly greater than the width, $w_m$, of the mattress 100. The central portion 62 of the top layer 60 includes a first edge 70 and a second edge 80. Two appendages (or straps) 72, 74 extend from the first edge 70 of the central portion 62 of the top layer 60; however, fewer or more appendages could also extend from the first edge 70 of the central portion 62 of the top layer 60 without departing from the spirit and scope of the present invention. Each of the appendages 72, 74 includes a closure means 90, which, in this exemplary embodiment, is in the form of a second (bottom) portion of a snap fastener. Indeed, in this exemplary embodiment, there are two such closure means 90 on each appendage 72, 74, the importance of which is described below.

Referring still to FIG. 4, two appendages (or straps) 82, 84 also extend from the second edge 80 of the central portion 62 of the top layer 60; however, fewer or more appendages could also extend from the second edge 80 of the central portion 62 of the top layer 60 without departing from the spirit and scope of the present invention. Each of the appendages 82, 84 includes a closure means 92, which, in this exemplary embodiment, is again in the form of a second (bottom) portion of a snap fastener. Indeed, in this exemplary embodiment, there are two such closure means 92 on each appendage 82, 84, the importance of which is described below.

Referring still to FIG. 4, the appendages 72, 74, 82, 84 may be integral with the central portion 62 of the top layer 60, or the appendages 72, 74, 82, 84 may be separate components sewn or similarly secured to the central portion 62 of the top layer 60. In this exemplary embodiment, similar to the base layer 20, the appendages 72, 74, 82, 84 are separate components and constructed of an elastic material. The appendages 72, 74, 82, 84 are sewn to the respective first and second edges 70, 80 of the central portion 62 of the top layer 60.

Referring to FIGS. 1-4, in use, a base layer 20 of the comfort system 10 is positioned below the mattress 100, in this case, between the mattress 100 and box springs 102. The base layer 20 is solely for positioning for the comfort system, and thus, one preferred material for the base layer 20 is duck cloth, which is a heavy, plain-woven cotton fabric that is strong, durable, and machine-washable. Duck cloth can also be treated with antimicrobial solutions if needed for a particular environment, such as a healthcare setting. Other materials that may be used for the base layer 20 include, but are not limited to: polyester, polyester/nylon blend, neoprene, hydrophobic fabrics, and smart fabrics. Furthermore, in this exemplary embodiment, the base layer 20 has a width, $w_1$, of approximately sixteen inches (16"), the importance of which is further described below, and the appendages 32, 34, 42, 44 each have a width, $w_3$, of approximately three to four (3-4") inches.

Referring still to FIGS. 1-4, in use, the top layer 60 is placed over an upper surface of the mattress 100 (and, in this case on top of the mattress pad 104). The top layer 60 is intended to contact the body of an individual. The material for the top layer 60 will depend on which part of the body it is intended to contact. For example, for an individual prone to bedsores, a layer of wicking material (i.e., a blend of polyester and nylon) may be combined with a layer of padded material in constructing the top layer. The appropriate selection of material for the top layer 60 is further described below. In this exemplary embodiment, like the base layer 20, the top layer 60 has a width, $w_3$, of approximately sixteen inches (16"), the importance of which is further described below, and the appendages 72, 74, 82, 84 each have a width, $w_4$, of approximately three to four (3-4") inches.

Referring again to FIGS. 1-2, the top layer 60 is connected to the base layer 20 via the respective appendages 32, 34, 42, 44, 72, 74, 82, 84 on either side of the mattress 100. Specifically, the appendage 72 of the top layer 60 is aligned with the appendage 32 of the base layer 20, the appendage 74 of the top layer 60 is aligned with the appendage 34 of the base layer 20, and so on. Once the respective appendages 32, 34, 42, 44, 72, 74, 82, 84 are aligned, the closure means 50, 52, 90, 92 can be used to secure them together. For example, in the exemplary embodiment shown in FIGS. 1-2, the first portion of a snap fastener (closure means 50) of the appendage 32 is snapped to the second portion of a snap fastener (closure means 90) of the appendage 72, the first portion of a snap fastener (closure means 50) of the appendage 34 is snapped to the second portion of a snap fastener (closure means 90) of the appendage 74, and so on. In this regard, the multiple closure means 50, 52, 90, 92 on each appendage 32, 34, 42, 44, 72, 74, 82, 84 allow the comfort system 10 to be readily installed on mattresses of various thicknesses.

With respect to connecting the base layer 20 to the top layer 60, snap fasteners are particularly well-suited for this purpose. Of course, a wide variety of snap fasteners exist in the art and are commercially available. Such commercially available snap fasteners could be readily used in the comfort system 10 of the present invention. For minimizing the possibility of microbial growth on the snap fasteners, copper may be a preferred material for the snap fasteners; indeed, copper is often used in high-tough areas in healthcare settings. Other materials suitable for the snap fasteners include, but are not limited to, stainless steel and bronze.

As described above, the top layer 60 is intended to contact the body of an individual, and the material for the top layer 60 will depend on which part of the body it is intended to contact. Furthermore, in this exemplary embodiment and as described above, the top layer 60 is approximately sixteen inches (16") wide. Since many mattresses are commonly eighty inches (80") long (including twin, twin XL, full, queen, king, and California king mattresses), in this example, the mattress 100 can be characterized as having five zones, which are designated A-E in FIG. 1. (Zone A, which is at the head of the bed, would often be occupied by one or more pillows.) The comfort system can be moved along the length of the mattress 100 to correspond to any of these zones A-E, and the material of the top layer 60 can be selected to correspond with the body part(s) most often in each zone.

For example, for an individual prone to bedsores, a layer of wicking material (e.g., a blend of polyester and nylon) may be combined with (i.e., tightly bonded to) a layer of padded material in constructing the top layer 60, and that top layer 60 may be positioned, for instance, in Zone C.

For another example, for an individual with night sweats or hot flashes, the top layer 60 may be comprised of a single layer wicking material (e.g., a blend of polyester and nylon) and positioned in Zone B or any other zone that would provide relief.

With respect to the wicking material in each of the above examples, the present applicant currently markets and sells bedding materials that are made of a blend of 53% polyester and 47% nylon, which are used to provide a wicking and cooling function. Such wicking material is one example of a material that could be used in the comfort system 10 of the present invention.

For yet another example, for an individual with incontinence, the top layer 60 may be comprised of a material capable of absorbing fluids and positioned in Zones C or D. Indeed, in at least some implementations, it is contemplated that the top layer would have a multi-layered construction, with: (i) a first (or uppermost) layer made of a wicking material (i.e., a blend of polyester and nylon); (ii) a second (or intermediate) layer made of an absorbent material; and (iii) a third (or lowermost) layer made of a waterproof material and/or a smart fabric. Furthermore, in such a multi-layered construction, sensors for identifying the occurrence of incontinent events could be incorporated into the second (or intermediate) layer.

For still yet another example, for an individual with dry skin on their feet and/or toes, the top layer 60 may be comprised of a smooth material and positioned in Zone E, i.e., in the position shown in FIGS. 1-2.

The dimensions provided above are only for purposes of example, and the dimensions of the base layer 20 and the top layer 60 can be readily adjusted to account for different mattress sizes and/or different applications. For example, in an alternate embodiment, it is contemplated that the base layer 20 has a width, $w_1$, of approximately twenty-four inches (24"), and the top layer 60 similarly has a width, $w_2$, of approximately twenty-four inches (24"). As compared to the exemplary embodiment described above with respect to FIGS. 1-2, if the mattress was still eighty inches (80") long and was still characterized as having five zones, the top layer 60 could thus be positioned to span two adjacent zones. For example, for an individual with incontinence, the top layer 60 may be comprised of an absorbent material and positioned to span Zones C and D.

In the exemplary embodiments described above, the base layer 20 and the top layer 60 have the same dimensions. However, that is not necessary for the function of the comfort system of the present invention. For example, in alternate embodiments, the base layer could be wider than the top layer. Indeed, the base layer could extend the length of the mattress, with appendages at spaced intervals along the length of the mattress, so that the comfort system of the present invention could be repositioned by moving the top layer, but not the base layer. Furthermore, in such a configuration, more than one top layer could be connected to the base layer, with each top layer in a specified zone (or zones).

As a further refinement, either the top layer 20 or the base layer 60 could be provided with rubber microdots or similar slip-resistant features to assist in maintain their positions with respect to the mattress 100.

Finally, the present invention may also be characterized as a kit, with a single base layer and multiple top layers, with each of the top layers being comprised of a different material suitable for a particular malady or use.

One of ordinary skill in the art will recognize that additional embodiments and implementations are also possible without departing from the teachings of the present invention. This detailed description, and particularly the specific details of the exemplary embodiments and implementations disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A comfort system for use with a mattress, comprising:

a base layer configured for placement below the mattress, including a central portion that is configured to extend from a first side of the mattress to a second side of the mattress, the central portion having a first edge at the first side of the mattress and a second edge at the second side of the mattress, one or more appendages that extend from the first edge of the central portion of the base layer, each of the one or more appendages including a closure means, and one or more appendages that extend from the second edge of the central portion of the base layer, each of the one or more appendages including a closure means; and a top layer configured for placement over an upper surface of the mattress, including a central portion that is configured to extend from the first side of the mattress to the second side of the mattress, the central portion having a first edge and a second edge, one or more appendages that extend from the first edge of the central portion of the top layer, each of the one or more appendages including a closure means that corresponds to and is adapted to engage one of the closure means of the one or more appendages that extend from the first edge of the central portion of the base layer, and one or more appendages that extend from the second edge of the central portion of the top layer, each of the one or more appendages including a closure means that corresponds to and is adapted to engage one of the closure means of the one or more appendages that extend from the second edge of the central portion of the base layer;

wherein each of the closure means of the one or more appendages that extend from the first edge of the central portion of the base layer is a first portion of a fastener;

wherein each of the closure means of the one or more appendages that extend from the first edge of the central portion of the top layer is a second portion of the fastener;

wherein each of the closure means of the one or more appendages that extend from the second edge of the central portion of the base layer is a first portion of another fastener; and wherein each of the closure means of the one or more appendages that extend from the second edge of the central portion of the top layer is a second portion of the other fastener.

2. The comfort system as recited in claim 1, wherein each fastener is a snap fastener.

3. The comfort system as recited in claim 1, wherein each of the one or more appendages that extend from the first edge of the central portion of the base layer and each of the one or more appendages that extend from the second edge of the central portion of the base layer are constructed of an elastic material and are sewn to the respective first and second edges of the central portion of the base layer; and wherein each of the one or more appendages that extend from the first edge of the central portion of the top layer and each of the one or more appendages that extend from the second edge of the central portion of the top layer are constructed of an elastic material and are sewn to the respective first and second edges of the central portion of the top layer.

4. A system, comprising:

a mattress;

a base layer positioned below the mattress, including a central portion that extends from a first side of the mattress to a second side of the mattress, the central portion having a first edge at the first side of the mattress and a second edge at the second side of the mattress, one or more appendages that extend from the first edge of the central portion of the base layer, each of the one or more appendages including a closure means, and one or more appendages that extend from the second edge of the central portion of the base layer, each of the one or more appendages including a closure means;

a top layer positioned over an upper surface of the mattress, including a central portion that extends from the first side of the mattress to the second side of the mattress, the central portion having a first edge and a second edge, one or more appendages that extend from the first edge of the central portion of the top layer, each of the one or more appendages including a closure means that corresponds to and is adapted to engage one of the closure means of the one or more appendages that extend from the first edge of the central portion of the base layer, and one or more appendages that extend from the second edge of the central portion of the top layer, each of the one or more appendages including a closure means that corresponds to and is adapted to engage one of the closure means of the one or more appendages that extend from the second edge of the central portion of the base layer;

wherein each of the closure means of the one or more appendages that extend from a first edge of the central portion of the base layer is a first portion of a fastener;

wherein each of the closure means of the one or more appendages that extend from the first edge of the central portion of the top layer is a second portion of the fastener;

wherein each of the closure means of the one or more appendages that extend from the second edge of the central portion of the base layer is a first portion of another fastener; and wherein each of the closure means of the one or more appendages that extend from the second edge of the central portion of the top layer is a second portion of the other fastener.

5. The system as recited in claim 4, wherein each fastener is a snap fastener.

6. The system as recited in claim 4, wherein each of the one or more appendages that extend from the first edge of the central portion of the base layer and each of the one or more appendages that extend from the second edge of the central portion of the base layer are constructed of an elastic material and are sewn to the respective first and second edges of the central portion of the base layer; and wherein each of the one or more appendages that extend from the first edge of the central portion of the top layer and each of the one or more appendages that extend from the second edge of the central portion of the top layer are constructed of an elastic material and are sewn to the respective first and second edges of the central portion of the top layer.

7. A kit for use with a mattress, comprising:

a base layer configured for placement below the mattress, extending from a first side of the mattress to a second side of the mattress, and further including a central portion that is configured to extend from the first side of the mattress to the second side of the mattress, the central portion having a first edge at the first side of the mattress and a second edge at the second side of the mattress, one or more appendages that extend from the first edge of the central portion of the base layer, each of the one or more appendages including a closure means, and one or more appendages that extend from the second edge of the central portion of the base layer, each of the one or more appendages including a closure means; and multiple top layers, each of the multiple top layers configured for placement over an upper surface of the mattress, extending from the first side of the mattress to the second side of the mattress;

wherein each of the multiple top layers is configured to connect to the base layer at the first side of the mattress and at the second side of the mattress;

wherein each of the multiple top layers is comprised of a different material;

wherein each of the multiple top layers include a central portion that is configured to extend from the first side of the mattress to the second side of the mattress, the central portion having a first edge and a second edge, one or more appendages that extend from the first edge of the central portion of each of the multiple top layers, each of the one or more appendages including a closure means that corresponds to and is adapted to engage one of the closure means of the one or more appendages that extend from the first edge of the central portion of the base layer, and one or more appendages that extend from the second edge of the central portion of each of the multiple top layers, each of the one or more appendages including a closure means that corresponds to and is adapted to engage one of the closure means of the one or more appendages that extend from the second edge of the central portion of the base layer;

wherein each of the closure means of the one or more appendages that extend from the first edge of the central portion of the base layer is a first portion of a fastener;

wherein each closure means of the one or more appendages that extend from the first edge of the central portion of each of the multiple top layers is a second portion of the fastener;

wherein each of the closure means of the one or more appendages that extend from the second edge of the central portion of the base layer is a first portion of another fastener; and wherein each of the closure means of the one or more appendages that extend from the second edge of the central portion of each of the multiple top layers is a second portion of the other fastener.

8. The kit as recited in claim 7, wherein each fastener is a snap fastener.

9. The kit as recited in claim 7, wherein each of the one or more appendages that extend from the first edge of the central portion of the base layer and each of the one or more appendages that extend from the second edge of the central portion of the base layer are constructed of an elastic material.

10. The kit as recited in claim 7, wherein each of the one or more appendages that extend from the first edge of the central portion of each of the multiple top layers and each of the one or more appendages that extend from the second edge of the central portion of each of the multiple top layers are constructed of an elastic material.

* * * * *